US009275811B2

(12) United States Patent
Naiman et al.

(10) Patent No.: US 9,275,811 B2
(45) Date of Patent: Mar. 1, 2016

(54) SWITCHING UNIT FOR AN ELECTRICAL SWITCHING DEVICE AND ELECTRICAL SWITCHING DEVICE

(71) Applicants: Pavel Naiman, Letohrad (CZ); Milos Petracek, Letohrad (CZ)

(72) Inventors: Pavel Naiman, Letohrad (CZ); Milos Petracek, Letohrad (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 322 days.

(21) Appl. No.: 13/709,411

(22) Filed: Dec. 10, 2012

(65) Prior Publication Data

US 2013/0192966 A1 Aug. 1, 2013

(30) Foreign Application Priority Data

Jan. 30, 2012 (DE) ..... 10 2012 201 260

(51) Int. Cl.

| | |
|---|---|
| ***H01H 5/08*** | (2006.01) |
| ***H01H 21/22*** | (2006.01) |
| ***H01H 21/42*** | (2006.01) |
| ***H01H 71/50*** | (2006.01) |

(52) U.S. Cl.

CPC ..... *H01H 21/22* (2013.01); *H01H 5/08* (2013.01); *H01H 21/42* (2013.01); *H01H 71/505* (2013.01)

(58) Field of Classification Search

CPC ..... H01H 5/08; H01H 5/06; H01H 21/36; H01H 21/38; H01H 21/40; H01H 21/42; H01H 71/505

USPC ..... 200/400, 462–467

See application file for complete search history.

(56) References Cited

U.S. PATENT DOCUMENTS

| | | | | |
|---|---|---|---|---|
| 4,146,765 | A | 3/1979 | Wilson | |
| 4,789,848 | A | 12/1988 | Castonguay et al. | |
| 4,888,570 | A | 12/1989 | Toda | |
| 5,016,140 | A * | 5/1991 | Prestel et al. | 200/463 |
| 7,459,650 | B2 * | 12/2008 | Weister et al. | 200/400 |
| 7,800,007 | B2 * | 9/2010 | Soundararajan et al. | 200/400 |
| 8,119,942 | B2 * | 2/2012 | Yang et al. | 200/400 |
| 8,796,574 | B2 * | 8/2014 | Kishi et al. | 200/467 |
| 2008/0078666 | A1 | 4/2008 | Ohda et al. | |
| 2008/0237016 | A1 | 10/2008 | Briggs | |

FOREIGN PATENT DOCUMENTS

| | | | |
|---|---|---|---|
| DE | 3114717 | A1 | 10/1982 |
| DE | 3717733 | C1 | 6/1988 |
| DE | 3829366 | A1 | 3/1989 |
| DE | 3851465 | T2 | 2/1995 |
| DE | 4336480 | C2 | 11/1995 |
| DE | 19703972 | C1 | 5/1998 |
| DE | 19802189 | C1 | 5/1999 |
| DE | 102007044475 | A1 | 4/2008 |

* cited by examiner

*Primary Examiner* — Felix O Figueroa

(74) *Attorney, Agent, or Firm* — Harness, Dickey & Pierce, P.L.C.

(57) ABSTRACT

A switching unit includes a pawl and a pawl spring, embodied such that, when a switching lever of the switching unit is moved from an ON position into a TRIP position and/or from the TRIP position into a RESET position, the pawl spring is bent by contact with a lateral face of the pawl. An electrical switching device, such as a circuit breaker, including at least one such switching unit is also disclosed.

16 Claims, 5 Drawing Sheets

SWITCHING UNIT FOR AN ELECTRICAL SWITCHING DEVICE AND ELECTRICAL SWITCHING DEVICE

PRIORITY STATEMENT

The present application hereby claims priority under 35 U.S.C. §119 to German patent application number DE 10 2012 201 260.5 filed Jan. 30 2012, the entire contents of which are hereby incorporated herein by reference.

FIELD

At least one embodiment of the invention generally relates to an electrical switching device, in particular a circuit breaker, such as a compact circuit breaker.

BACKGROUND

Electrical switching devices, such as circuit breakers, have the task of decoupling one or a number of consumers from a power supply network if a specific fault occurs. The classical fault is the occurrence of a short-circuit current, and the circuit breakers are usually configured to move a switching unit during such a short-circuit current and thus to decouple the connection between consumers and the power supply network.

After an electrical switching device of this type has tripped, the switching unit of the electrical switching device is reset. This means that the switching unit is moved from a TRIP position into a RESET position by means of a swivel lever. This reset process forms part of a switching process of an electrical switching device and it is therefore necessary, after tripping the switching device, to reset the switching device by way of a reset process in order then to be able switch on the same.

During the reset process, in other words the movement of the swivel lever of the switching device from the TRIP position into the RESET position, the spring element or elements, which press or presses the pawl of the switching unit of the electrical switching device against a tensioning lever of the switching unit, are tensioned. This is necessary since large forces are required in order to close the contacts of the electrical switching device when switching on the electrical switching device.

One of the main problems during the reset process is the friction of components in the switching unit, in particular between the surfaces of the tripping mechanism, in particular the tripping shaft, and the pawl, which are in contact with one another during the reset process, in other words the movement of the switching unit from the TRIP position into the RESET position. If the friction between the pawl and the tripping mechanism is too great for instance, it may ensue that the pawl cannot slide from the contact surface of the tripping mechanism and can therefore not pivot. In this case, the pawl cannot be moved or reset and the electrical switching device, for instance a compact circuit breaker, cannot be switched on after the reset process. If the pawl cannot be released from the contact surface of the tripping mechanism, in particular the tripping shaft, the switching unit is not correctly reset, so that during the subsequent switch-on of the electrical switching device or switching unit of the electrical switching device, the pawl cannot hold the tensioning lever of the switching unit in the RESET position and the switching unit is therefore not transferred into the ON position, but instead into the TRIP position.

With the Modeion-3VT1 circuit breaker by Siemens AG, the problem was hitherto solved as follows: FIG. 1 shows a schematic representation of a part of the switching unit of this known circuit breaker. In this FIG. 1, the circuit breaker is tripped, in other words it is in the TRIP position. An operator of the circuit breaker can reset the switching unit of the circuit breaker by actuating the tensioning lever 5.

The switching unit comprises a pawl 2 and a tripping mechanism 1. The pawl 2 and the tripping mechanism 1 are mounted in a pivotable and rotatable manner on a side wall 10 of the circuit breaker. A pawl spring 9 is clamped between the pawl 2 and the tripping mechanism 1, which exerts a required torque on the pawl 2 and also on the tripping mechanism 1. The force exerted by the pawl spring 9 or the torque exerted by the pawl spring 9 generates contact forces and frictional forces between the tripping mechanism 1 and the pawl 2.

During the reset process, it should be ensured that the frictional forces between the pawl 2 and the tripping mechanism 1 do not prevent the pawl 2 from pivoting or rotating in the direction toward the tensioning lever 5 of the switching unit. The pawl 2 must pivot or rotate in order to jump onto the tensioning lever 5. If the operator relinquishes control of the tensioning lever 5 in the RESET position, spring elements, in particular also the pawl spring 9, of the switching unit, generate a torque which pivots the tensioning lever 5, so that the tensioning lever 5, in particular the contact surface 7 of the tensioning lever 5, comes into contact with the pawl 2, in other words the contact surface 8 of the pawl 2.

Subsequently the pawl 2 pivots and is stopped in the RESET position by the contact surface 6 of the tripping mechanism 1. After the RESET position of the switching unit is reached, the circuit breaker can be switched on. In order to implement the switch-on process, the frictional torque between the pawl 2, in other words the contact surface 8 of the pawl 2, and the tripping mechanism 1, in other words the contact surface 7 of the tripping mechanism 1, must be smaller than the torque available to rotate the pawl 2 in the direction of the tensioning lever 2. This is ensured in the Modeion-3VT1 circuit breaker by different timing sequences of different parts of the pawl 2 and of the tripping mechanism 1.

The pawl 2 has a curved region 11 with a chamfer 12. The tripping mechanism 1 accordingly comprises an additional hook 3. These two elements or surfaces 12, 3 are in contact during the reset process in order mainly to reduce the frictional forces and also to protect sensitive surfaces of the tripping mechanism 1 and the pawl 2, in particular the contact surface 4 of the pawl 2, which is in contact with the tensioning lever 5 when the circuit breaker is switched on and which has to fulfill its function if the circuit breaker is tripped.

An additional hook 3 or an additional surface is provided for the movement of the tripping mechanism 1, which is/are in contact with the pawl 2 and therefore rotates the same. This prevents the contact surface 12 of the pawl 2 from coming into contact with a corner of the tripping mechanism 1. Accordingly, there is no friction between these two parts, which means that lower forces are needed to move the tripping mechanism 1.

The Modeion-3VT1 circuit breaker is disadvantageous in that additional elements, such as the hook 3 of the tripping mechanism 1 and the curved region 11 of the pawl 2 are needed in order to ensure the functionality of the switching unit. These additional elements are especially cost-intensive. More material is required on the one hand and on the other hand these elements must be manufactured very precisely and calibrated to one another in order to ensure the functionality of the switching unit and thus of the circuit breaker, in particular of the reset process of the switching unit of the circuit breaker.

SUMMARY

At least one embodiment of the present invention creates a switching unit for an electrical switching device, in particular a circuit breaker, and an electrical switching device, in particular a circuit breaker, which can be manufactured easily and cost-effectively, and which enable a simple and secure resetting of the electrical switching device. In particular, it should be prevented that, on account of frictional forces occurring, the reset process of the switching unit or of the electrical switching device cannot be performed.

Further features and details of the invention result from the subclaims of the description and the drawings. In such cases features and details which are described in conjunction with the inventive switching unit naturally also apply in conjunction with the inventive electrical switching device and vice versa in each case, so that, in relation to the disclosure, reference is or can always be made reciprocally to the individual invention aspects.

According to a first aspect of at least one embodiment of the invention, the object is achieved by a switching unit for an electrical switching device, in particular a circuit breaker, such as a compact circuit breaker, comprising the following elements:

a switching mechanism for connecting and separating at least one moving contact from at least one fixed contact of the electrical switching device, which comprises a tensioning lever which is rotatably mounted about a stationary tensioning lever axis, at least one rocker moveably mounted on the tensioning lever and a hinge mechanism for moving the moving contact, wherein the tensioning lever is actively connected hereto in order to move the moving contact by way of the hinge mechanism, a pawl for latching and unlatching the tensioning lever, a switching lever which can be pivoted about a stationary bearing axis for manually connecting and separating the moving contact by way of the switching mechanism, wherein the switching lever can be manually pivoted between an OFF position and an ON position and manually or automatically pivoted between a TRIP position and a RESET position, a tensioning roller, which can be driven by way of a switching lever such that when the switching lever is moved, the tensioning roller is actively connected to the tensioning lever in order to pivot the tensioning lever by rolling along a tensioning contour of the tensioning lever, a tripping mechanism which is rotatably mounted about an axis of rotation, which can be brought into detachable active contact with a pawl contact surface of the pawl in the TRIP position of the switching unit by way of at least one tripping contact surface of the tripping mechanism, and a pawl spring, which is arranged between the pawl and the tripping mechanism and which tensions the pawl and the tripping mechanism with one another at least in the TRIP position. The switching unit is also characterized by the pawl and the pawl spring being embodied such that, when the switching lever is moved from the ON position into the TRIP position and/or from the TRIP position into the RESET position, the pawl spring is bent by contact with a lateral face of the pawl.

BRIEF DESCRIPTION OF THE DRAWINGS

An inventive switching unit for an electrical switching device and its advantages is described in more detail below with the aid of drawings, in which, shown schematically in each instance:

FIG. 4 shows the switching unit according to FIG. 2 in the RESET position, in which an electrical switching device can be switched on.

DETAILED DESCRIPTION OF THE EXAMPLE EMBODIMENTS

Figure 1:
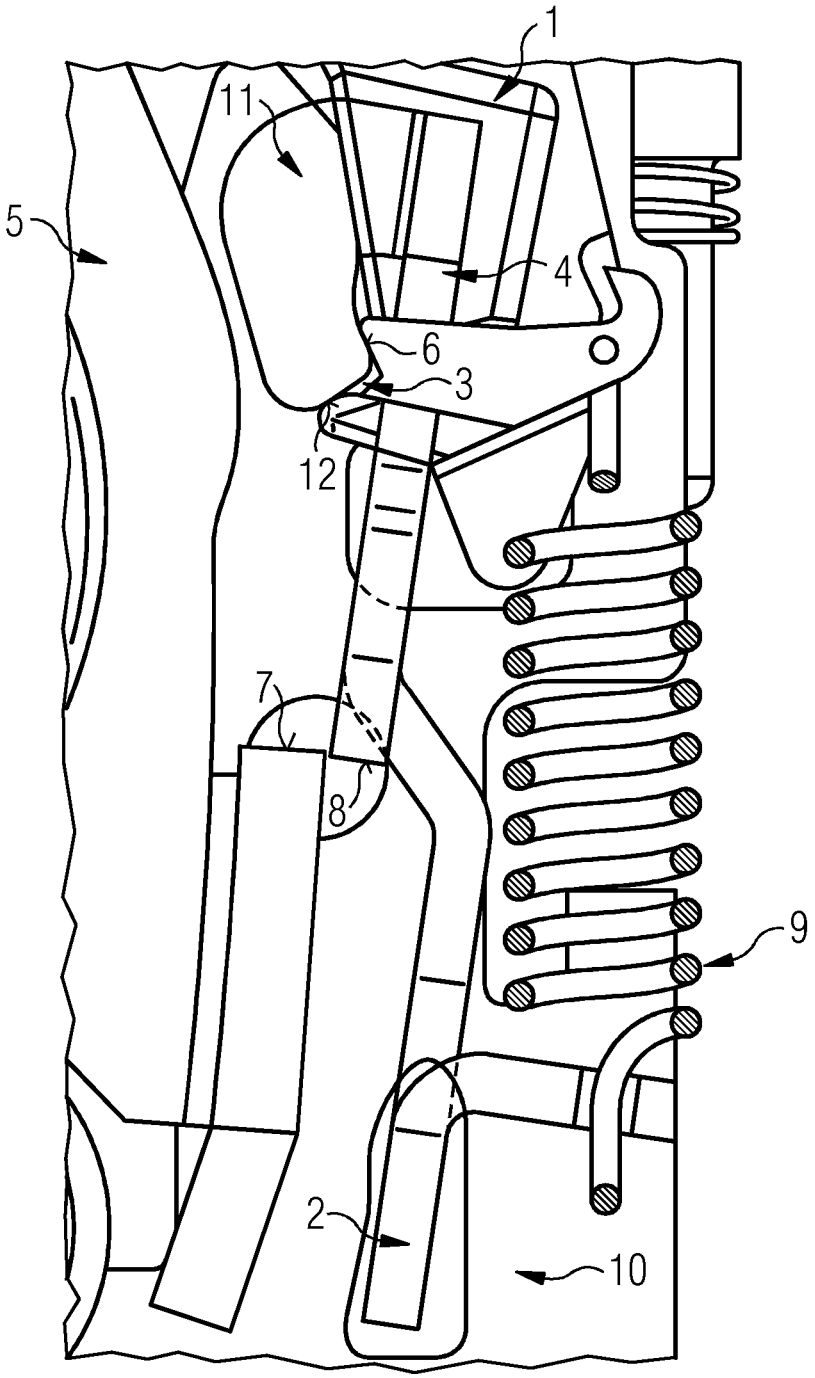
FIG 1 (Prior art)
FIG. 1 shows a sectional diagram of a switching unit for circuit breaker according to the prior art.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A switching unit embodied in this way for an electrical switching device, in particular for a circuit breaker, can be produced in a simple and cost-effective manner, and enables a simple and secure resetting of the electrical switching device. The special embodiment of the switching unit prevents the reset process of the switching unit and thus of the electrical switching device from not being able to be performed on account of frictional forces occurring between the pawl and the tripping mechanism. The special embodiment of the pawl and pawl spring of the switching unit ensures that during the reset process, in other words the pivoting of the switching lever from the TRIP position into the RESET position, an additional torque is exerted by the pawl spring on the pawl and on the tripping mechanism, wherein the additional torque is exerted by the bending of the pawl spring through a lateral face of the pawl, which is in contact with the spring when the reset process is performed.

The pawl and the pawl spring can be embodied such that the pawl spring comes into contact with the lateral face of the pawl during the movement of the switching lever from the TRIP position into the RESET position and is as a result bent. The pawl and the pawl spring are preferably embodied such that the pawl spring already comes into contact with the lateral face of the pawl and is as result bent with a movement of the switching lever from the ON position into the TRIP position. This herewith ensures that even at the start of the reset process, an additional force and thus an additional torque is exerted on the pawl or on the tripping mechanism, so that this is moved such that the pawl contact surface slides securely from the tripping contact surface of the tripping mechanism.

Additional force or additional torque means that a further force is exerted by the pawl spring on the pawl or the tripping mechanism by bending the pawl spring, the force assisting the normal force of the ratchet spring, in other words the force which the pawl spring exerts on the pawl or on the tripping mechanism, if this is not bent, but is instead only clamped. The torque also produced by bending the pawl spring is great enough in this case, together with the torque which the ratchet spring, on account of its arrangement between the tripping mechanism and the pawl, exerts on the pawl or the tripping mechanism, for it to overcome the frictional force between the pawl and the tripping mechanism, in other words between the tripping contact surface of the tripping mechanism and the pawl contact surface of the pawl, and as a result to rotate the pawl in the direction of the tensioning lever in order to reach the RESET position.

A switching unit of this type for an electrical switching device is simpler by comparison with the described switching unit of the prior art. No additional elements are required on the pawl and on the tripping mechanism of the switching unit. The switching unit can also be produced more cost-effectively hereby, since less material is required for the pawl. By comparison with the switching unit according to the prior art, this solution of the switching unit allows the pawl and the tripping mechanism to be manufactured with a little less accuracy, since fewer stop surfaces have to provided herebetween.

By comparison with the switching unit of the described prior art, the inventive switching unit of at least one embodiment enables an at least equally sized force to be provided for the tripping of the switching unit, but nevertheless a larger force in order to rotate the pawl during the reset process. By comparison with the described prior art, no new or additional elements are required on the pawl and on the tripping mechanism in order to realize the reset process. Only the arrangement of the pawl spring relative to the pawl is such that the pawl spring comes into contact herewith with a specific movement of the pawl, so that the pawl spring is bent by the pawl.

The pawl spring can in principle be embodied in various ways. A switching unit is particularly preferred in which the pawl spring is embodied as a tension spring. A first end of the pawl spring is advantageously arranged on the side of the pawl on which the pawl is pivotably or rotatably mounted with a side wall of the switching unit. The second end of the pawl spring embodied as a tension spring is arranged on the tripping mechanism, which is in particular a tripping shaft. Here the pawl spring embodied as a tensioning spring may have, for example, English or German fastening hooks.

According to a particularly preferred development of at least one embodiment of the invention, provision can be made with a switching unit for the diameter of the pawl spring embodied as a tension spring to be large enough, with the movement of the switching lever from ON position into the TRIP position and/or from the TRIP position into the RESET position, for the pawl spring to be bent by contact with the lateral face of the pawl. In particular, the part of the windings of the tension spring comes into contact with the lateral face of the pawl which faces the first end of the pawl spring.

According to a preferred development of at least one embodiment of the invention, provision can be made with a switching unit for the tripping contact surface of the tripping mechanism to be arranged on a projection of the tripping mechanism and for the pawl contact surface of the pawl to be formed in the pawl by a depression, in particular a recess, wherein in the TRIP position the tripping contact force of the tripping mechanism rests in a frictional manner at least partially on the pawl contact surface of the pawl.

The tripping mechanism advantageously comprises a base body which can be rotated about an axis of rotation of the tripping mechanism, on which the projection is arranged. The pawl contact surface is formed in the pawl by a depression, particularly preferably by a recess, in particular a corner recess. In this way the pawl contact surface is advantageously inclined, in particular by 90°, relative to the longitudinal extension of the pawl. In the TRIP position, the tripping contact surface of the projection of the tripping mechanism rests at least partly in a frictional manner on the pawl contact surface of the pawl. The friction fit is affected by the pretensioning of the pawl spring in this TRIP position. The bending of the pawl spring in the TRIP position ensures that when the switching lever is moved from the TRIP position into the RESET position, in other words during a reset process of the switching unit, the pawl contact surface and the tripping contact surface slide away from one another in order to release the pawl from the tripping mechanism. This is assisted by the additional force which is exerted by the bending of the pawl spring.

According to a second aspect of at least one embodiment of the invention, an electrical switching device is disclosed, which comprises at least one switching unit according to the first aspect of at least one embodiment of the invention. Advantages which have been described in respect of a switching unit according to the first aspect of at least one embodiment of the invention, therefore naturally also result for at least one embodiment of an inventive electrical switching device, which comprises a switching unit of this type.

The electrical switching device is preferably a circuit breaker, in particular a compact circuit breaker. Circuit breakers are in particular electromagnetic automatic switches. They can be used in particular as automatic cutouts to safeguard currents against short-circuit and/or overload. A use as a motor protection switch is widespread. The embodiment of the electrical switching device as a circuit breaker, in particular as a compact circuit breaker, enables the electrical switching device to be used in a large bandwidth of electrical applications.

As already mentioned in the introduction to the description, a switching unit of the Modeion-3CT1 circuit breaker made by Siemens AG is shown in FIG. 1, which represents the prior art relative to the inventive switching unit.

Figure 2:
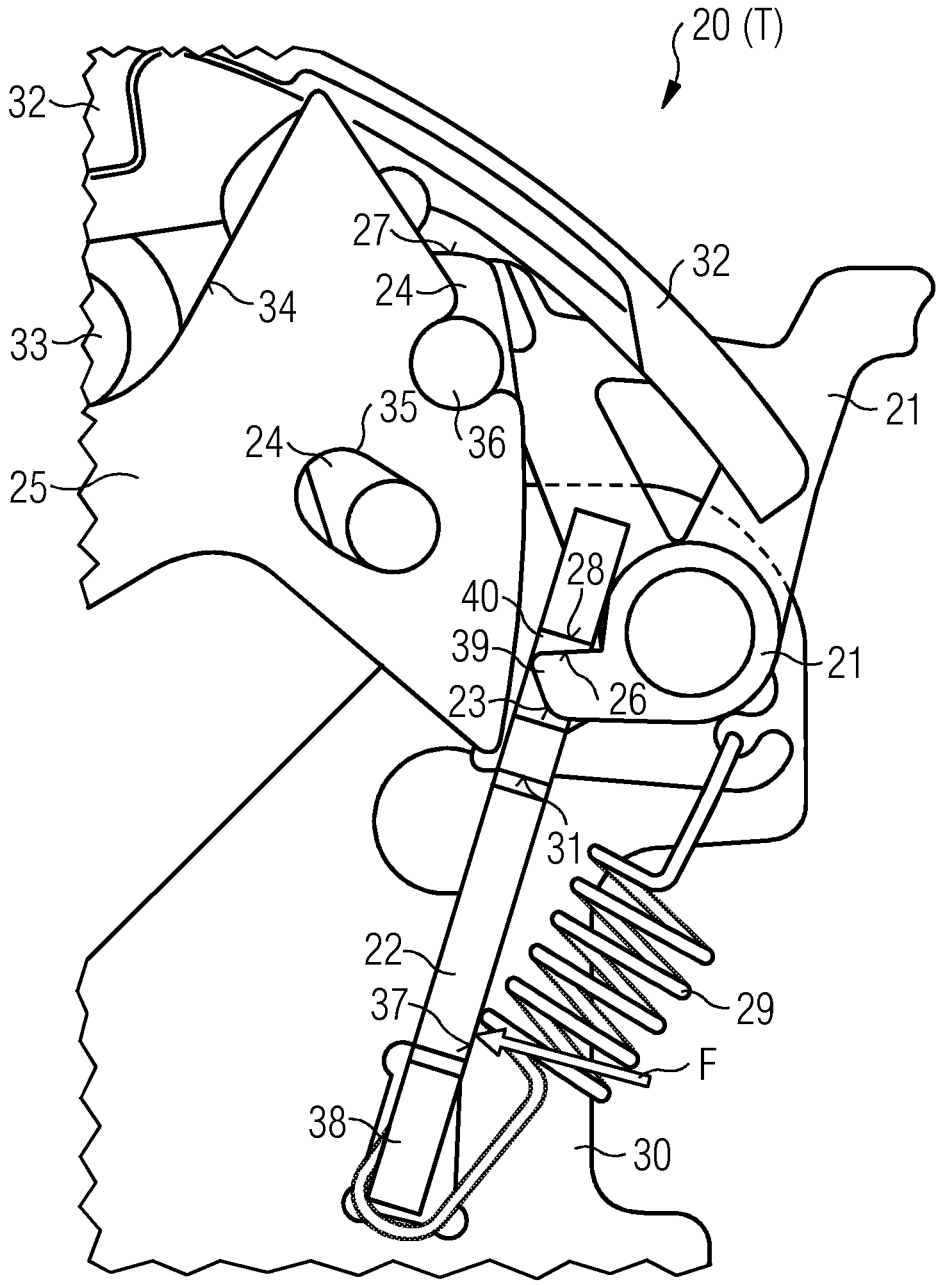
FIG. 2 shows a sectional diagram of part of a switching unit for an electrical switching device, wherein the switching unit is embodied according to an embodiment of the inventive construction principle and is in the TRIP position.
Figure 3:
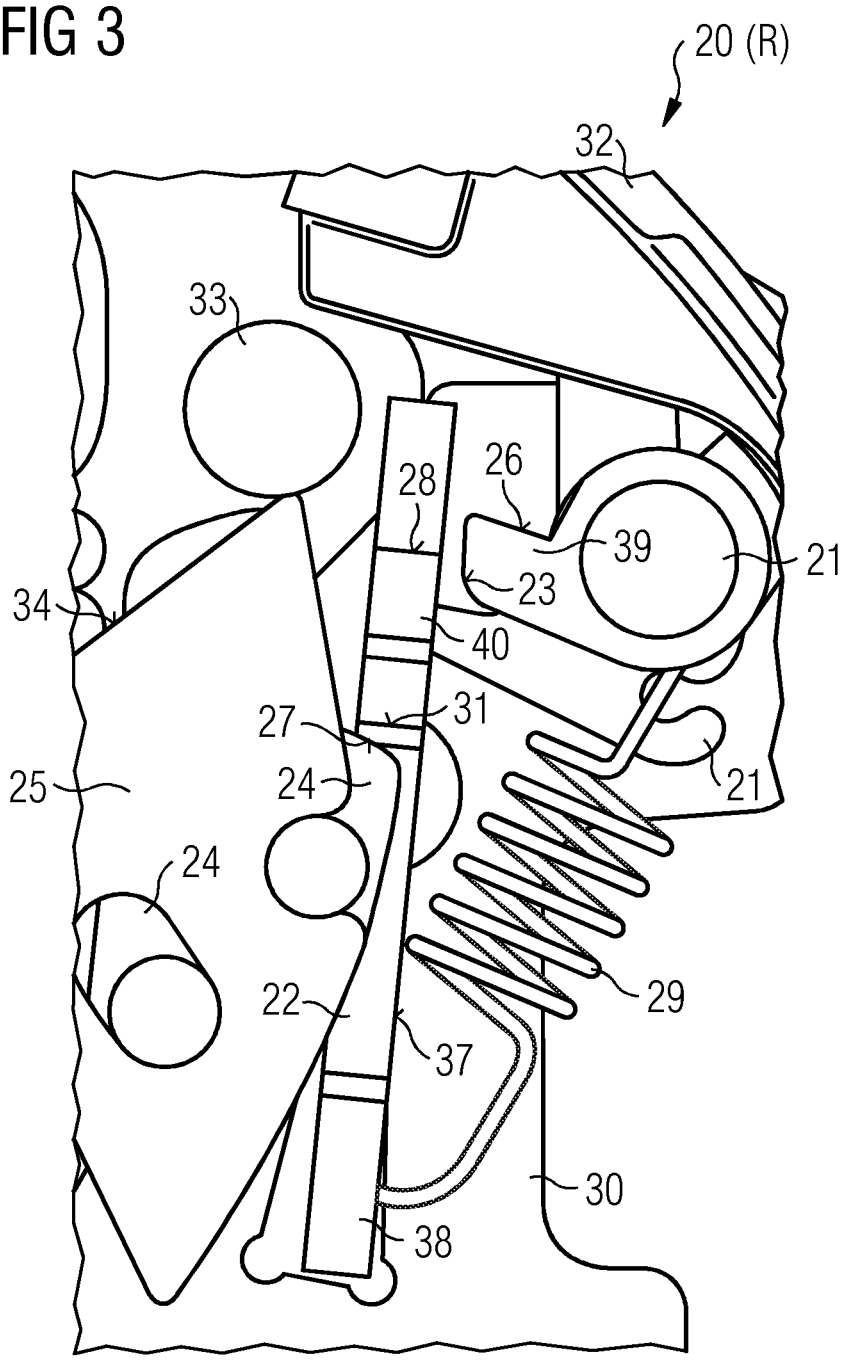
FIG. 3 shows the switching unit according to FIG. 2 in the RESET position.
Figure 4:
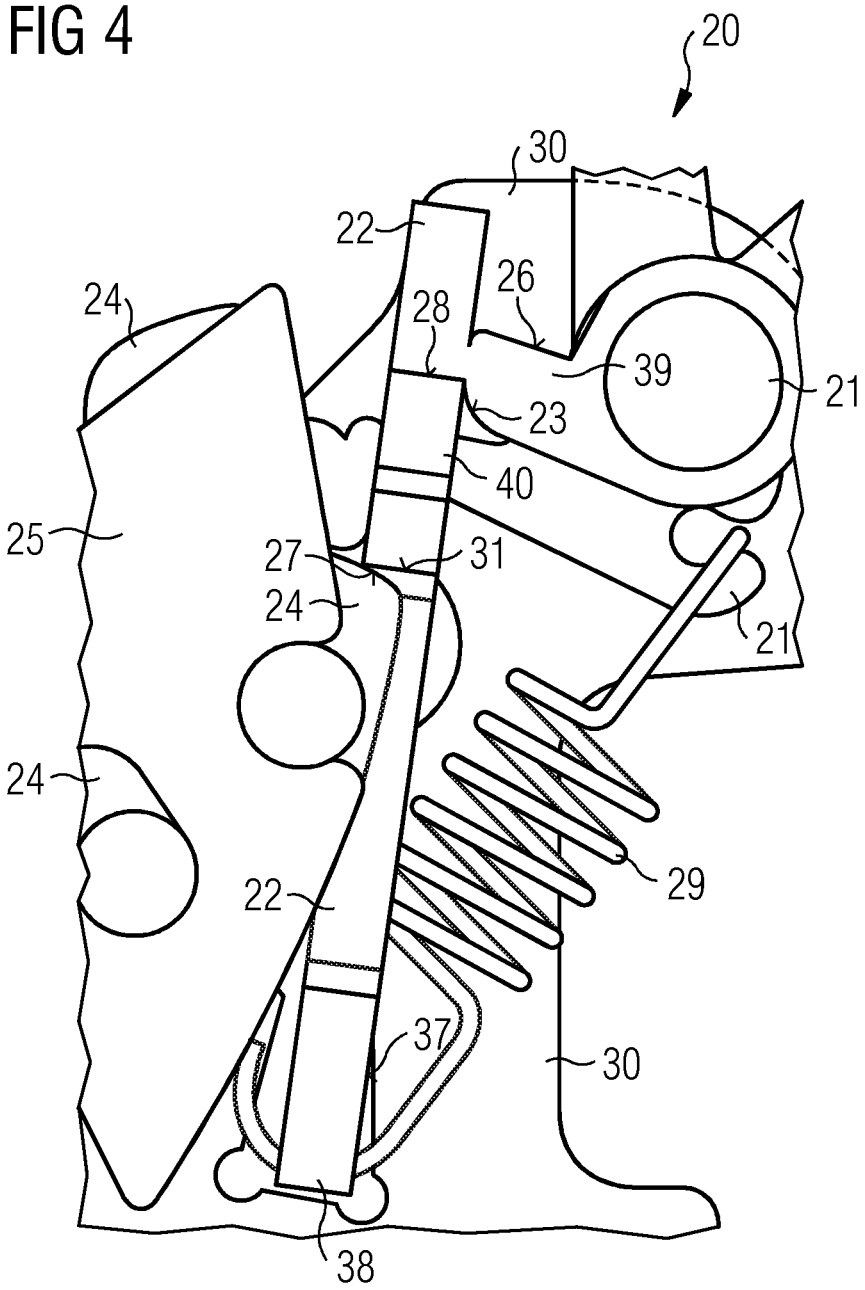

Elements with the same function and mode of operation are provided with the same reference characters in FIGS. 2 to 4.

FIG. 2 shows a schematic diagram in a sectional view of part of a switching unit 20, which is embodied according to the inventive construction principle. The switching unit 20 can be used in an electrical switching device, in particular in a circuit breaker, such as a compact circuit breaker. The switching unit 20 comprises a switching mechanism for connecting and separating at least one moving contact from at least one fixed contact of an electrical switching device. The switching mechanism comprises a tensioning lever 25 which is rotatably mounted about a stationary tensioning lever axis, a rocker 24 mounted moveably on the tensioning lever 25 and a hinge mechanism for moving the moving contact. The tensioning lever 25 is actively connected via the hinge mechanism (not shown in more detail) in order to move the moving contact. The bearing of the tensioning lever 25 can be provided at the end of the tensioning lever 25 (not shown) or in a central region of the tensioning lever 25.

Furthermore, the switching unit comprises a pawl 22 for latching or unlatching the tensioning lever 25. This means that the pawl 22 is used to interact with the tensioning lever 25 in order to hold the same in the ON position. The switching unit furthermore includes a switching lever 32 which can be rotated about a stationary bearing axis in order to manually connect and separate the moving contact by way of the switching mechanism, wherein the switching lever can be manually pivoted between an OFF position and an ON position and manually or automatically pivoted between a TRIP position T and a RESET position R. The switching lever can be gripped by an operator of the electrical switching device in order to switch the switching lever manually between an OFF and ON position. Furthermore, the switching lever 32 can be gripped by an operator in order to transfer the switching lever 32 from a TRIP position T into the RESET position R, in order to reset the switching unit 20.

The switching unit also comprises a tensioning roller 33, which can be driven by way of the switching lever 32 such that when the switching lever 32 is moved, the tensioning roller 33 is in active contact with the tensioning lever 25 in order to pivot the tensioning lever 25 by rolling along a tensioning contour 34 of the tensioning lever 25. This means that a tensioning roller 33 rests on the tensioning contour 34 of the tensioning lever 25, which can be driven by way of the switching lever 32 such that when the switching lever 32 is moved, the tensioning roller 33 on the tensioning contour 34 of the tensioning lever 25 is rolled there along and as a result pivots the same. The tensioning roller 33 is advantageously arranged in a rotationally moveable manner on the switching lever 32.

With a movement of the tensioning lever 25 on account of rolling the tensioning roller 33 on the tensioning contour 34 of the tensioning lever 25, a tensioning element, in particular a spring, of the switching mechanism, which is not shown, is tensioned or relaxed. In other words, depending on the direction in which the tensioning roller 33 rolls along the tensioning curve 34 of the tensioning lever 24, the tensioning element is tensioned or relaxed.

The switching unit furthermore comprises a tripping mechanism 21 which is rotatably mounted about an axis of rotation, and which is actively connected, in a detachable manner, via at least one tripping contact surface 26 to a pawl contact surface 28 of the pawl 22 in the TRIP position T of the switching unit 20. The pawl spring 29 of the switching unit 20 is arranged between the pawl 22 and the tripping mechanism 21, which is also referred to as spring lock.

In the TRIP position T of the switching unit 20 shown in FIG. 2, the pawl spring 29 embodied as a tension spring is extended, so that this tensions the pawl 22 and the tripping mechanism 21 with one another. The pawl 22 and the pawl spring 29 are embodied such that, with a movement of the switching lever 32 from the ON position into the TRIP position T, the pawl spring 29 is bent by contact with a lateral face 37 of the pawl 22. This is shown in FIG. 2.

One region of the pawl spring 29 embodied as a tension spring rests on a lateral face 37 of the pawl 22, on account of the movement of the pawl spring 29 relative to the pawl 22, as a result of which the pawl spring 29 is bent. The bent pawl spring 29 exerts a force F on the pawl 22 or exerts a torque on the pawl 22, which in addition to the normal tensioning force of the pawl spring 29 also provides for a reset process, in other words the transition of the switching unit 20 from the TRIP position T into the RESET Position R, which is shown in FIG.

3. This additional force, which is exerted by bending the pawl spring 29 on the pawl 22 or the tripping mechanism 21, ensures that the tripping contact surface 26 of the tripping mechanism 28 and the pawl contact surface 28 of the pawl 22 slide apart from one another during the reset process.

In FIG. 2, the switching unit 20 of the electrical switching device is tripped. In order to perform the reset process, an operator of the switching unit 20 or of the electrical switching device pivots the switching lever 32. He/she herewith controls the tension of the tensioning lever 25. The pawl spring 29 is clamped in the TRIP position T between the pawl 22 and the tripping mechanism 21, said pawl spring thereupon exerting a required torque for the pawl 22 and similarly for the tripping mechanism 21 in specific directions. The torque of the pawl spring 29 generates specific contact forces or frictional forces between the pawl 22 and the tripping mechanism 21.

It should be ensured during the reset process that these frictional forces or contact forces between the pawl 22, in other words the pawl contact surface 28 and the pawl 22, and the tripping mechanism 21, or the tripping contact surface 26 of the tripping mechanism 21, do not prevent the rotation of the pawl 22 in the direction of the tensioning lever 25. The pawl 22 must rotate during the reset process in order to jump onto the rocker 24, in other words engage with a stop surface 27 of the rocker 24.

This RESET position R of the switching unit 20 is shown in FIG. 3. If the operator releases the switching lever 32 in the RESET position R, he simultaneously releases control of the tensioning lever 25. The pawl spring 29 and the spring element (not shown), which act on the tensioning lever 25, effect a rotation of the tensioning lever 25, the rocker 24 or the stop surface 27 of the rocker 24 and the second contact surface 31 of the pawl 22 engage with each other. If the pawl 22 rotates and is stopped in the RESET position R by the second contact surface 23 of the tripping mechanism 21, the switching unit is in the status which allows the electrical switching device to be switched on. This status of the switching unit 20, in which the switching unit 20 and the electrical switching device can be switched on, is shown in FIG. 4.

The rocker 24 of the switching unit 20 can be moved in a guide bar 35 and on a bearing element 36 relative to the tensioning lever 25.

Figure 5:
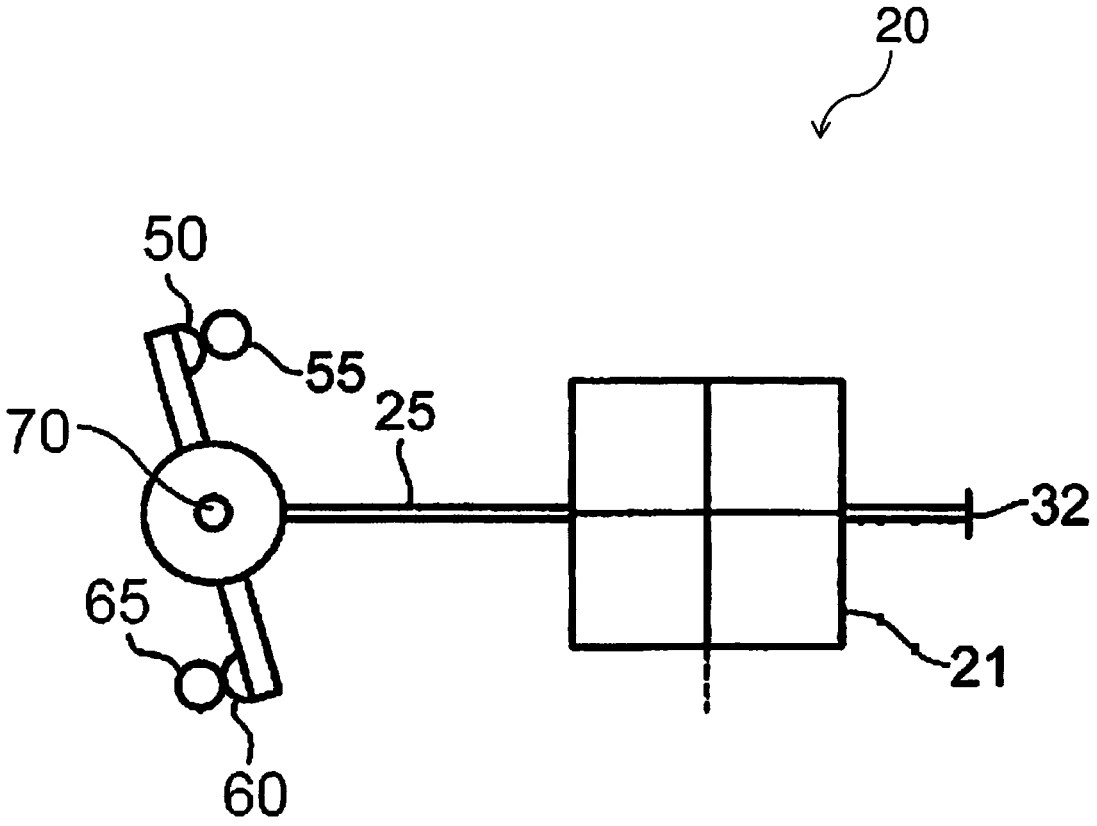
FIG. 5 shows a schematic of the switching unit of FIG. 2.

FIG. 5 shows a schematic of the switching unit of FIG. 2.

As shown in FIG. 5, the switching lever 32 of the switching unit 20 is connected to the tensioning lever 25 of the tripping mechanism 21. The tensioning lever 25 extends from the tripping mechanism 21 to a hinge mechanism 70 that drives moving contacts 50 and 60 to be in contact with fixed contacts 55 and 65 (e.g., while the tripping mechanism 21 is in the ON position) or separated from fixed contacts 55 and 65 (e.g., while the tripping mechanism 21 is in the TRIP position).

The afore-described embodiment of the switching unit 20 only describes the present invention within the scope of an example. Other embodiments of the switching unit 20 are naturally also conceivable.

The explanation of the aforecited embodiment of the switching unit only describes the present invention within the scope of an example.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Tripping mechanism
2 Pawl
3 Hook
4 Contact surface of the pawl
5 Tensioning lever
6 Contact surface of the tripping mechanism
7 Contact surface of the tensioning lever
8 Contact surface of the pawl
9 Pawl spring
10 Side wall of the circuit breaker
11 Bent region of the pawl
12 Chamfer at the bent region of the pawl
20 Switching unit
21 Tripping mechanism
22 Pawl
23 Second contact surface of the tripping mechanism
24 Rocker
25 Tensioning lever
26 Tripping contact surface of the tripping mechanism
27 Contact surface of the rocker
28 Catch contact surface of the pawl
29 Contact spring
30 Side wall

31 Second contact surface of the pawl
32 Switching lever
33 Tensioning roller
34 Tensioning contour of the rocker
35 Guide bar
36 Bearing element
37 Lateral face of the pawl
38 First end of the pawl
39 Projection of the tripping mechanism
40 Depression/recess in the pawl
(T) TRIP position
(R) RESET position

What is claimed is:

1. A switching unit for an electrical switching device, comprising:

a switching mechanism, configured to connect and separate at least one moving contact from at least one fixed contact of the electrical switching device, the switching mechanism including a tensioning lever, at least one rocker moveably mounted on the tensioning lever and a hinge mechanism for moving the moving contact, the tensioning lever being actively connected to the moving contact to move the moving contact by way of the hinge mechanism;

a pawl configured to latch and unlatch the tensioning lever;

a switching lever configured to manually connect and separate the moving contact via the switching mechanism, the switching lever being manually or automatically pivotable between a TRIP position and a RESET position;

a tensioning roller, drivable by way of the switching lever such that, when the switching lever is moved, the tensioning roller is actively connected to the tensioning lever in order to pivot the tensioning lever by rolling along a tensioning contour of the tensioning lever;

a tripping mechanism, actively connected in a detachable manner to a pawl contact surface of the pawl via at least one tripping contact surface of the tripping mechanism in the TRIP position (T) of the switching unit; and a pawl spring, arranged between the pawl and the tripping mechanism, configured to tension the pawl and the tripping mechanism at least in the TRIP position, the pawl and the pawl spring being embodied such that, when the switching lever is moved into the TRIP position, the pawl spring is bent by contact with a lateral face of the pawl.

2. The switching unit of claim 1, wherein the pawl spring is embodied as a tension spring.

3. The switching unit of claim 2, wherein a diameter of the pawl spring embodied as the tension spring is large enough, when the switching lever is moved into the TRIP position, for the pawl spring to be bent by contact with the lateral face of the pawl.

4. The switching unit of claim 1, wherein a first end of the pawl spring is configured to engage on a side of the pawl, on which the pawl is pivotably or rotatably mounted on a side wall of the switching unit.

5. The switching unit of claim 1, wherein the tripping contact surface of the tripping mechanism is arranged on a projection of the tripping mechanism and wherein the pawl contact surface of the pawl is formed in the pawl by a depression, wherein in the TRIP position, the tripping contact surface of the tripping mechanism is configured to rest at least partially in a frictional manner against the pawl contact surface of the pawl.

6. An electrical switching device, comprising at least one switching unit of claim 1.

7. The electrical switching device of claim 6, wherein the electrical switching device is a circuit breaker.

8. The switching unit of claim 1, wherein the switching unit is for a circuit breaker.

9. The electrical switching device of claim 6, wherein the electrical switching device is a circuit breaker.

10. An electrical switching device, comprising at least one switching unit of claim 2.

11. The electrical switching device of claim 10, wherein the electrical switching device is a circuit breaker.

12. An electrical switching device, comprising at least one switching unit of claim 3.

13. The electrical switching device of claim 12, wherein the electrical switching device is a circuit breaker.

14. The electrical switching device of claim 7, wherein the electrical switching device is a compact circuit breaker.

15. The electrical switching device of claim 11, wherein the electrical switching device is a compact circuit breaker.

16. The electrical switching device of claim 13, wherein the electrical switching device is a compact circuit breaker.

* * * * *